United States Patent [19]

Turner

[11] Patent Number: 4,784,526

[45] Date of Patent: Nov. 15, 1988

[54] ARCTIC OFFSHORE STRUCTURE AND INSTALLATION METHOD THEREFOR

[75] Inventor: J. Ward Turner, Houston, Tex.

[73] Assignee: Exxon Production Research Company, Houston, Tex.

[21] Appl. No.: 58,110

[22] Filed: Jun. 4, 1987

[51] Int. Cl.[4] ..... E02B 17/02

[52] U.S. Cl. ..... 405/204; 166/335; 405/217; 405/225; 405/227

[58] Field of Search ..... 405/195, 203, 204, 211, 405/217, 224, 227, 225; 166/335

[56] References Cited

U.S. PATENT DOCUMENTS

| | | | |
|---|---|---|---|
| 1,868,494 | 7/1932 | Collins | 405/223 |
| 4,080,795 | 3/1978 | Weidler | 405/227 |
| 4,102,144 | 7/1978 | Anders | 405/217 X |
| 4,114,388 | 9/1978 | Straub | 405/216 |
| 4,205,928 | 6/1980 | Thompson et al. | 405/217 |
| 4,245,929 | 1/1981 | Pearce et al. | 405/211 |
| 4,265,569 | 5/1981 | Gefvert | 405/217 |
| 4,427,320 | 1/1984 | Bhula | 405/211 |
| 4,484,841 | 11/1984 | Einstabland | 405/217 X |
| 4,666,343 | 5/1987 | Butt et al. | 405/217 |

FOREIGN PATENT DOCUMENTS

| | | | |
|---|---|---|---|
| 158819 | 9/1984 | Japan | 405/217 |

*Primary Examiner*—David H. Corbin
*Attorney, Agent, or Firm*—Richard F. Phillips

[57] ABSTRACT

An arctic offshore platform adapted for use in hydrocarbon exploration and production operations conducted in relatively shallow waters with low to moderate ice environments. The arctic offshore platform of the present invention includes one or more support legs. Each support leg includes a base resting on the ocean floor, a central support column extending upward through the base to a position above the ocean surface and a sloped-sided member seated atop the base and extending upward around the central support column to a position above the ocean surface. In installation, the base and central support column are installed and secured to the ocean floor as a unit. Following this, the sloped-sided member is secured atop the base. The sloped-sided member causes ice sheets which may impact the support leg to fail in flexure, thus reducing the overall ice loadings on the support leg relative to the loading which would exist were the sloped-sided member absent. This provides a stable structure for conducting hydrocarbon exploration and production operations while requiring a minimum of onsite fabrication and construction for ease and simplicity in the onsite installation.

20 Claims, 2 Drawing Sheets

ARCTIC OFFSHORE STRUCTURE AND INSTALLATION METHOD THEREFOR

TECHNICAL FIELD

The present invention relates generally to offshore structures. More particularly, the present invention relates to offshore hydrocarbon drilling and production platforms for use in relatively shallow arctic waters with moderate to low ice loadings.

BACKGROUND OF THE INVENTION

Offshore platforms used in the exploration and production of oil and gas reserves located in arctic offshore regions must be capable of resisting the loads exerted by ice floes and various other ice formations present in arctic waters. These ice loadings can exert enormous lateral forces which in many instances are sufficient to damage or topple a conventional offshore platform. To resist these forces, arctic platforms are designed to be highly resistant to lateral loadings and typically include some feature to deflect or break ice floes contacting the platform.

In regions with low to moderate ice environments, such as the Norton Sound, Cook Inlet and Chukchi regions of offshore Alaska, the ice environment exists only over the fall, winter, and spring months and largely disappears during the summer. This allows for an open water construction period during the summer. The maximum ice loading events in these low to moderate ice environments are somewhat lower than those occurring in harsher environments such as the Beaufort Sea region north of Alaska. The platform of the present invention is designed to resist the many arctic ice loadings present in low to moderate ice environment regions to provide a stable structure for conducting hydrocarbon exploration and production operations in such regions.

Also, due to the often frigid and otherwise hostile environment of many arctic regions, it is desirable to minimize the amount of onsite fabrication and construction required in establishing an arctic offshore platform. The platform of the present invention is designed to require a minimum of such onsite fabrication and construction.

SUMMARY OF THE INVENTION

In accordance with the present invention, there is provided an arctic offshore platform which is particularly well adapted for use in hydrocarbon exploration and production operations conducted in relatively shallow waters with low to moderate ice environments. The platform comprises a deck structure such as a conventional integrated or modular deck structure, mounted atop one or more support legs. The support legs preferably include a base mounted around and attached to the lower portion of an elongated structural support column which extends upwardly from the base. The base is preferably hollow and drum-shaped in construction, and the column is preferably tubular in construction. The support legs also include a separate sloped-sided member, preferably hollow and frustoconical in shape, supported by the base and column and through which the column extends. The sloped-sided member extends above the water or ice line to cause impinging ice floes to break up and to prevent ice from damaging the structural support column. The base and sloped-sided member are provided with internal supports to resist structural damage from the forces exerted by ice floes.

The column and base are preferably constructed as a single substructure unit at an onshore fabrication yard and transported by barge or other means to the offshore installation site. Once onsite, the substructure unit is submerged so that the base rests on the seafloor and the column extends above the water line. Piles are then driven through pile conduits provided within the base or the column to anchor the assembly to the seafloor. The piles are attached to the pile conduits after driving by means of placing grout in the annulus or by means of a mechanical connector. The sloped-sided member is then placed upon the installed substructure unit by lowering the sloped-sided member over the column and onto the base so that the column extends upwardly through the sloped-sided member, and the sloped-sided member is supported by the base. The sloped-sided member can then be secured to the column and base assembly by grouting the annulus between the sloped-sided member and the vertical column. The deck structure is then mounted onto the constructed support legs in modular sections or placed thereon as a single integrated unit, depending upon the desired deck structure construction.

The arctic offshore platform of the present invention provides an effective means for conducting hydrocarbon exploration and production operations in relatively shallow arctic waters with low to moderate ice environments. The support legs of the platform resist ice loadings and provide a stable structure for conducting hydrocarbon drilling and production. The arctic offshore platform of the present invention also requires a minimum of onsite construction and fabrication, simplifying and decreasing the overall cost of the structure.

These and other features and advantages of the present invention will be more readily understood from a reading of the following detailed description with reference to the accompanying drawings.

BRIEF DESCRIPTION OF THE DRAWINGS

For a better understanding of the present invention reference may be had to the accompanying drawings in which.

These drawings are not intended as a definition of the invention, but are provided solely for the purpose of illustrating certain preferred embodiments of the invention, as described below.

DETAILED DESCRIPTION OF THE PREFERRED EMBODIMENT

The appended FIGURES illustrate two arctic offshore structures and various embodiments of support legs useful in supporting the work decks of these structures above the ocean surface. As will become apparent in view of the following discussion, the preferred embodiments of the platform support legs of the present invention are particularly well suited for use in conjunction with oil and gas drilling and production platforms situated in relatively shallow waters with seasonal ice floe existence such as may be found in the Norton Sound, Cook Inlet and Chukchi regions of Alaska. However, the platform support legs are also useful for mooring terminals and in other applications in which it is desirable to position a structural element above the ocean surface in an arctic region. To the extent the preferred embodiment, as described below, of the present invention is specific to supporting an oil and gas drilling and production platform in shallow arctic waters, this is by way of illustration rather than limitation.

Figure 1:
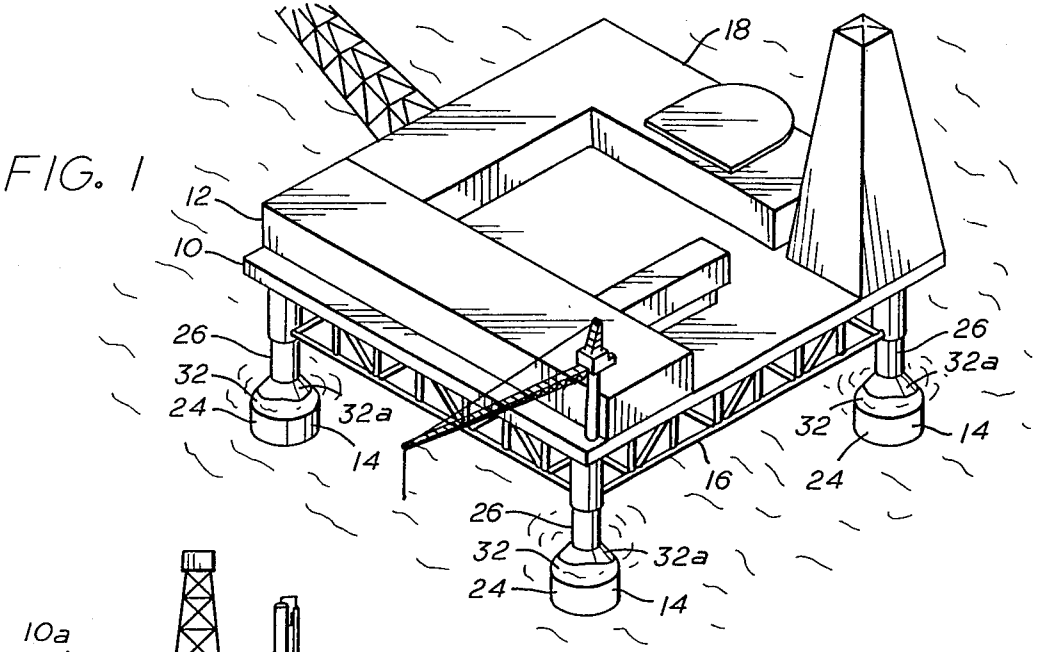
FIG. 1 is a perspective view of an arctic offshore platform incorporating a preferred embodiment of the present invention.

In a first embodiment, depicted in FIG. 1, the arctic offshore platform 10 includes a modular deck structure 12 mounted on a plurality of support legs 14 anchored to the seafloor. The support legs 14 are discrete units secured to one another only through the deck structure 12. The modular deck structure 12 includes a support frame 16 atop which the modules 18 are mounted. The modules 18 contain the equipment and support facilities necessary for hydrocarbon exploration and production.

Figure 2:
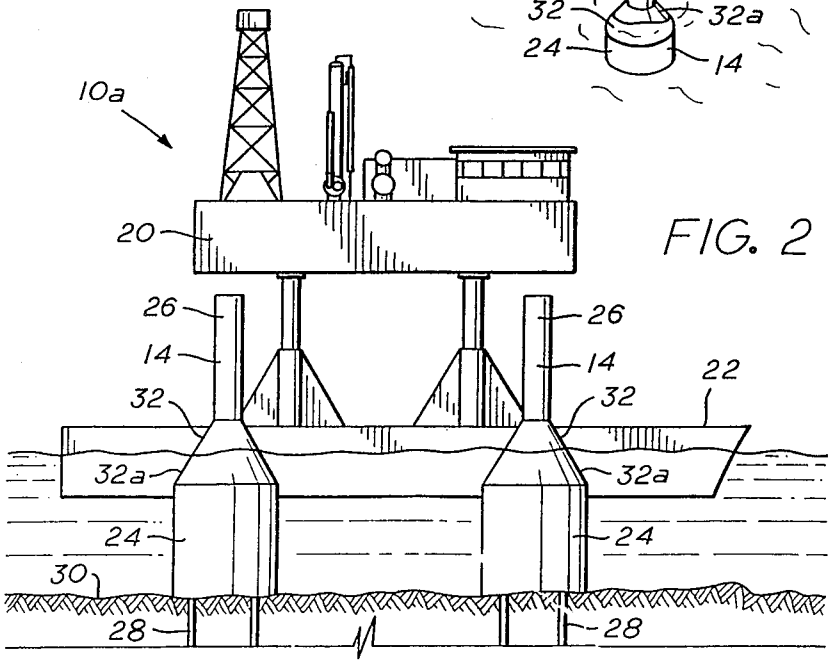
FIG. 2 is an elevational view of a second arctic offshore platform incorporating a preferred embodiment of the present invention.

In a second embodiment, shown in FIG. 2, the arctic offshore platform 10*a* comprises an integrated deck structure 20 mounted atop a plurality of support legs 14, these support legs 14 being similar to those set forth in FIG. 1. In FIG. 2 the integrated deck structure 20 is shown mounted on a barge 22 in position for lowering the deck structure 20 onto the support legs 14. The barge 22 has transported the integrated deck structure 20 from an onshore assembly location to the offshore installation site. The integrated deck structure 20 may be lowered onto the support legs 14 by ballasting the barge 22. Once the support legs 14 are supporting a substantial portion of the load of the integrated deck structure 20, the barge 22 is disengaged from the integrated deck structure 20 and returned to shore. Those skilled in the art will recognize other methods for mounting an integrated deck structure 20 on a set of support legs 14.

It should also be understood that the construction of, and equipment on, the modular deck structure 12 and the integrated deck structure 20 is not to be considered a limitation on the present invention, and the modular and integrated deck structures 12 and 20, respectively, may comprise any one of a number of standard deck structure designs suitable for the desired operation, such deck structures being well known to those skilled in the art. For smaller deck structures such as a single derrick, a satellite production platform or a mooring terminal, a single support leg 14 may be utilized. For larger deck structures, such as those shown in FIGS. 1 and 2, a plurality of support legs 14 may be necessary.

In the preferred embodiment, the support legs 14 each include a base 24 mounted around and attached to the lower portion 26*a* of a central column 26. The base 24 is configured to assist in anchoring the central column 26 to the seafloor 30, as detailed below.

Each support leg 14 includes a discrete sloped-sided member 32 carried by the base 24 and through which the structural support column 26 extends. The sloped-sided member 32 serves to minimize the lateral and overturning forces exerted on the support legs 14 by ice loading. The sloped sides 32*a* of the sloped-sided member 32 are constructed with a sufficient slope, preferably between 20° and 65° from the horizontal, to cause ice (indicated by reference numeral 33 in FIG. 5) impacting thereon to rise along the sloped sides 32*a*. This rise causes the ice to bend, placing the upper surfaces of the ice in tension. The tensile strength of ice is substantially lower than its compressive strength, and bending failure results from the tensile stresses applied thereto. As the ice breaks up in contact with the sloped-sided member 32, the lateral forces applied to the support legs 14 are greatly reduced, permitting use of a less massive support leg 14 than would otherwise be required.

Figure 3:
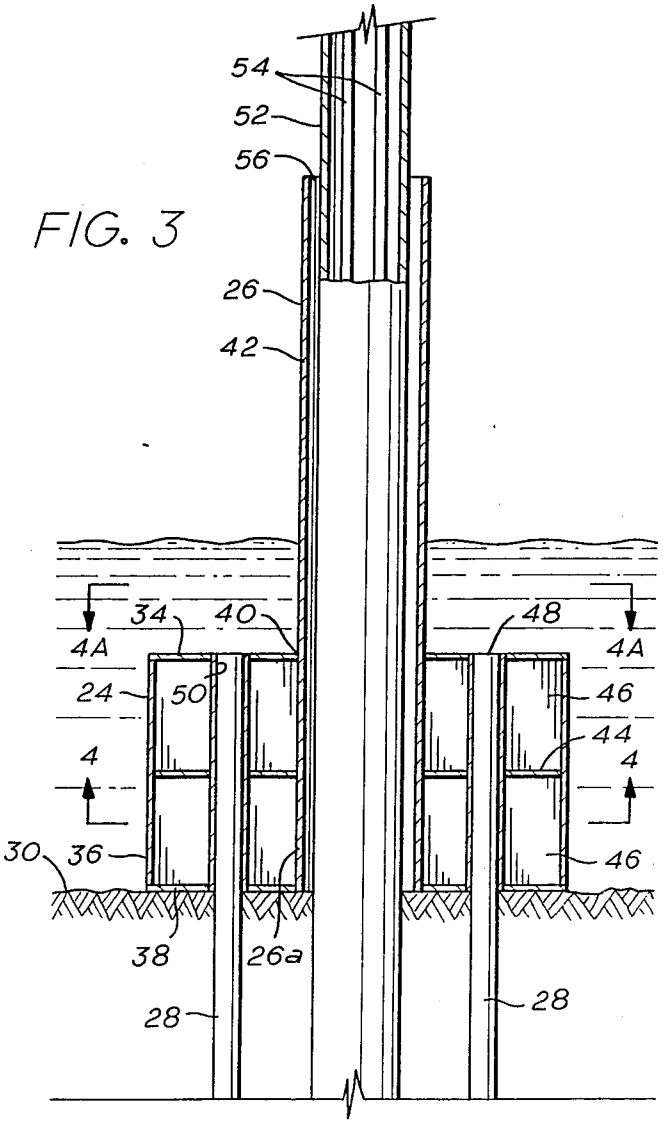
FIG. 3 is an elevational cut-away view of the substructure unit of a support leg of the platforms shown in FIGS. 1 and 2, this view shows the piling arrangement utilized for anchoring the support leg to the seafloor.
Figure 4:
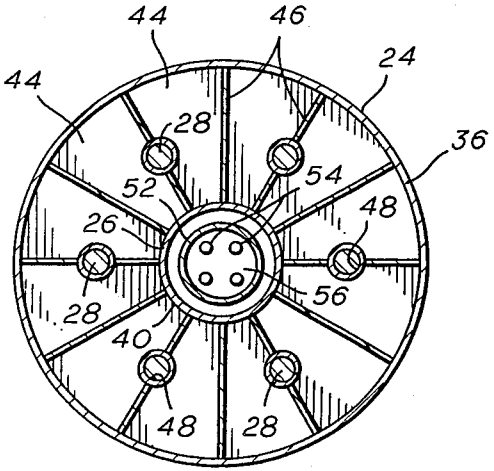
FIG. 4 is a cross section of the substructure unit leg taken along line 4—4 of FIG. 3.
Figure 4A:
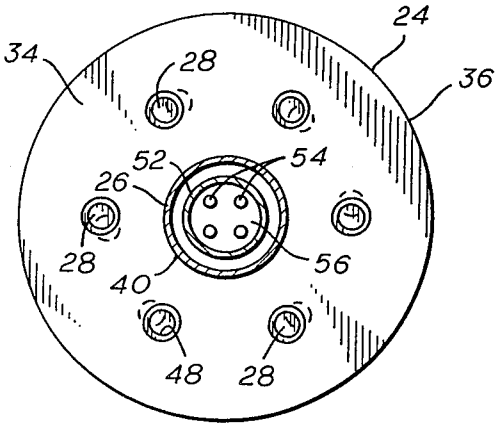
FIG. 4A is a plan view of the substructure unit showing the piling conduits in a battered arrangement.

FIGS. 3, 4, and 4A illustrate in greater detail a base 24 and a column 26 of the support leg 14 and various piling arrangements for anchoring the support leg 14 to the seafloor 30. The base 24 preferably comprises a cylindrical member having a top wall 34, a side wall 36 and a bottom wall 38. The base 24 has a central bore 40 through which the column 26 extends. The base 24 is partially hollow to minimize its weight and thereby facilitate its transportation to and placement at the offshore site. However, the base 24 must be constructed to resist structural loading from the ice forces exerted on it. Accordingly, the base 24 is provided with internal supports such as horizontal and vertical stiffeners 44 and 46. These internal supports may include steel bulkhead and web stiffener arrangements, orthotropically stiffened shells, double hull constructions, concrete stiffened panels, or ring stiffened shells.

The column 26 is preferably a tubular member having a central conduit 56 through which well conductors 54 can be driven, as detailed below. The column 26 extends through the central bore 40 of the base 24.

The base 24 and column 26 are preferably fabricated together as an integral unit onshore and subsequently towed by a barge to the offshore installation site. Once on site, the substructure unit is flooded to cause it to come to rest on the seafloor 30 with the column 26 extending above the water line. In some applications, it may be desirable to excavate the seafloor 30 to a depth of 2–5 meters at the installation site prior to installing the base 24 and then back-filling the excavation after the base 24 is in place. To anchor the substructure unit to the seafloor 30, the base 24 is provided with one or more pile conduits 48, extending through the base 24 in either a vertical (FIG. 4) or battered (FIG. 4A) arrangement. The battered arrangement is typically preferred because of the increased shear resistance of the entire support leg 14 provided by such an arrangement. Piles 28 are inserted through the pile conduits 48 and set into the seafloor 30 by any one of a number of conventional methods such as driving, vibration, or drilling. Once the piles 28 are set, grout may be injected into the annulus between each pile 28 and the corresponding pile conduit 48 to cement the piles 28 to the interior wall 50 of the pile conduits 48. However, those skilled in the art will recognize other methods for securing the piles 28 to the pile conduits 48.

For additional anchoring, a pile 52 may be driven into the seafloor 30 through the central conduit 56 and secured to the column 26. The central conduit 56 of the column 26 may be utilized for drilling and producing operations as a conduit for the well conductors 54.

Figure 5:
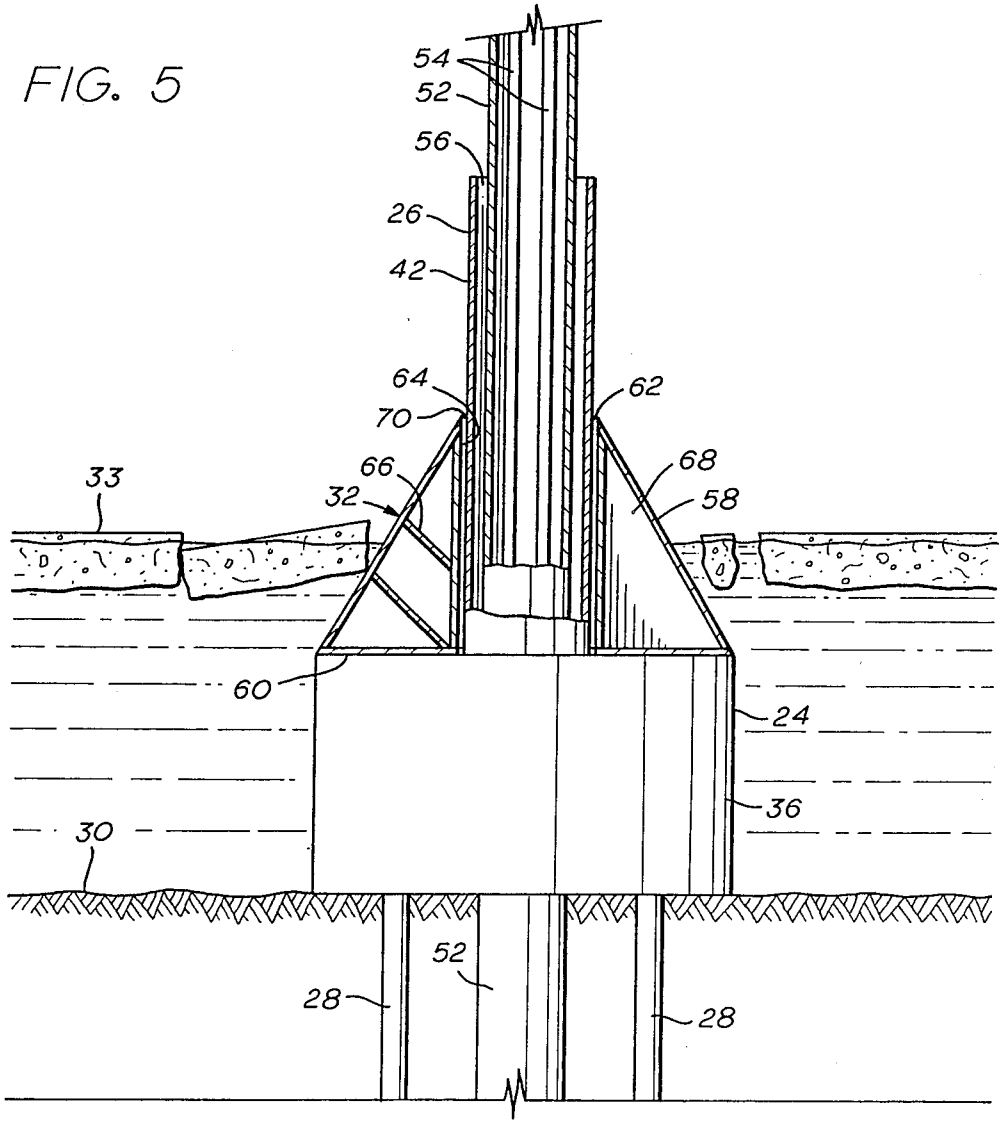
FIG. 5 is an elevational view partly in cross section of a support leg showing the sloped-sided member in cross section mounted onto the substructure unit.

FIG. 5 illustrates in greater detail the sloped-sided member 32. The sloped-sided member 32 has a frustoconical exterior wall 58, a bottom wall 60 and an interior central conduit 62 with an interior wall 64 preferably concentric with the exterior wall 42 of the column 26. The sloped-sided member 32 is partially hollow to minimize its weight. However, like base 24, sloped-sided member 32 must be constructed to resist the loads from the ice forces applied to it. To this end, the sloped-sided member 32 is provided with internal supports such as angular struts 66, vertical plates 68 or other internal support arrangements as previously described for the base 24.

The sloped-sided member 32 is constructed so that when placed upon the substructure unit, it extends above the water or ice line to prevent the ice from causing damage to the column 26. In some embodiments it may be necessary to provide means for flooding the sloped-sided member 32 to ensure that when placed upon the substructure unit, the sloped-sided member 32 will not float, but rather will rest upon the base 24.

The sloped-sided member 32, like the base 24 and the column 26, is preferably fabricated onshore and subsequently towed or barged to the offshore installation site. Once on site, the sloped-sided member 32 is placed upon the previously installed substructure unit by a crane barge or other means which lifts the sloped-sided member 32 over the column 26 so that the column 26 extends upwardly through the central conduit 62 of the sloped-sided member 32, which is then lowered to rest on the base 24. Grout is then injected into the annular space 70 between the interior wall 64 of the slope-sided member 32 and the exterior surface 42 of column 26. This secures the column 26 and the sloped-sided member 32 together to form a single support leg 14. One advantage of constructing and installing the base 24, the column 26 and the sloped-sided member 32 as individual modules is that the base 24 is secured to the seafloor 30 by piles 28 prior to positioning the sloped-sided member 32 atop the base 24. This avoids the need for apertures through the outer surface 58 of the sloped-sided member 32.

Once the required number of support legs 14 are assembled, set in place, and anchored to the seafloor 30, the deck structure may be mounted onto the columns 26 of the support legs 14 in individual sections (modular deck structure 12), placed thereon as a single unit (integrated deck structure 20), or mounted by any other means familiar to those skilled in the art, thereby forming the various arctic offshore platforms in accordance with the present invention.

Many modifications and variations besides the embodiment specifically mentioned may be made in the techniques and structures described herein and depicted in the accompanying drawings without departing substantially from the concept of the present invention. Accordingly, it should be clearly understood that the form of the invention described and illustrated herein is exemplary only, and is not intended to limit the scope of the claims appended hereto.

I claim:

1. A support leg for an arctic offshore platform, comprising:

a support leg base resting on an ocean bottom location, said support leg base defining a vertical aperture extending through said support leg base;

a central column secured to said support leg base and extending upward from said support leg base to a position a spaced distance above the ocean surface, said central column defining a vertical aperture aligned with said support leg base vertical aperture;

a plurality of well conductors extending downward through said central column to a position below the bottom of said central column;

a plurality of piles extending into the ocean bottom, each of said piles being secured to said support leg base; and a sloped-sided member defining a central aperture, said sloped-sided member being supported atop said base with said central column extending through said sloped-sided member central aperture, said sloped-sided member extending above the ocean surface.

2. The support leg as set forth in claim 1, wherein said support leg base is a tubular element having a lower end resting upon the ocean bottom and an upper end situated at a position intermediate the ocean bottom and the ocean surface.

3. The support leg as set forth in claim 1, wherein said sloped-sided member is fabricated as a single unit separate from said base and said central column, said sloped-sided member being adapted to be positioned on said base and central column following installation of said base and central column, whereby piles may be driven through said base securing it to the ocean bottom prior to positioning said sloped-sided member atop said base.

4. The support leg of claim 1, wherein said sloped-sided member comprises a partially hollow frustoconical member having a central conduit through which said central column extends, said sloped-sided member being provided with internal support means to resist structural damage from ice forces exerted thereon.

5. An arctic offshore platform, comprising:

a deck structure mounted onto one or more independent support legs, each of said support legs being anchored to the seafloor at an offshore site, each of said support legs including:

a substructure unit, said substructure unit having a base mounted around and attached to a lower portion of a central column, said central column having a lowermost end substantially flush with the bottom end of said base, said central column extending upwardly from said base to a position above a water line at said offshore site;

at least one pile extending through said substructure unit into said seafloor to anchor said substructure unit to said seafloor; and a sloped-sided member supported on said substructure unit and extending upward to a position above said water line, said central column extending upwardly through said sloped-sided member.

6. The arctic offshore platform of claim 5, wherein said central column comprises a tubular member.

7. The arctic offshore platform of claim 5, wherein said base comprises a substantially hollow drum-shaped member, said base being provided with internal support means to resist structural damage from ice forces exerted thereon.

8. The arctic offshore platform of claim 5, wherein said sloped-sided member comprises a substantially hollow frustoconical member having a central conduit through which said central elongated column extends, said sloped-sided member being provided with internal support means to resist structural damage from ice forces exerted thereon.

9. The arctic offshore platform of claim 5, wherein said each support leg is secured to said seafloor by piles, said piles extending upward into said base to a position below the upper surface of said base whereby said slope-sided member requires no provision for said piles.

10. An arctic offshore platform, comprising:

a deck structure supported a spaced distance above the ocean surface by a plurality of support legs, each of said support legs including:

a base element having a bottom surface, an upper surface at a position intermediate said ocean bottom and said ocean surface, and a wall portion joining said upper and lower surfaces, said base element defining a recess extending vertically through said base element;

a central column having a lower end secured within said base element recess and an upper end projecting upward from said base element to a location a spaced distance above the ocean surface, said central column projecting downward through said base element to a position no deeper than said base element bottom surface; and a sloped-sided member supported on said base element, said sloped-sided member having a lower end, an upper end and sloped walls joining said lower and upper ends, said sloped-sided member defining a recess extending vertically through said sloped-sided member, said recess being sized to permit said central column to extend therethrough, said sloped-sided member being fabricated as a module separate from said base and central column whereby said sloped-sided member can be positioned over said central column and lowered onto said base element following installation of said base element and said central column.

11. The arctic offshore platform as set forth in claim 10, wherein said base element wall portion is cylindrical and wherein said sloped-sided member is frustoconical, said base element wall portion and said sloped-sided member lower end having substantially equal diameters.

12. The arctic offshore platform as set forth in claim 10, wherein said sloped-sided member extends upward to a position above the ocean surface but below the uppermost end of said sloped-sided member.

13. The arctic offshore platform as set forth in claim 10, wherein said base element is positioned within a hole excavated in the ocean floor.

14. A method of constructing and installing a support leg for an arctic offshore platform at an offshore site, comprising the steps of:

fabricating a substructure unit at an onshore location, said substructure unit including a base mounted around and attached to a lower portion of a central column, said central column extending upwardly from said base;

constructing a separate sloped-sided member for said substructure unit at said onshore location;

transporting said substructure unit and said sloped-sided member to said offshore site;

submerging said substructure unit so that said base rests on the seafloor of, and said central column extends above a water line at said offshore site;

extending at least one pile through said substructure unit to anchor said substructure unit to said seafloor; and placing said sloped-sided member upon said substructure unit, wherein said sloped-sided member extends above said water line, and wherein said central column of said substructure unit extends upwardly through said sloped-sided member.

15. The method as set forth in claim 14, further including the step of excavating a hole in a seafloor at said offshore site prior to submerging said substructure unit, whereby said support leg rests within said excavated hole.

16. A method of constructing and intalling an arctic offshore platform at an installation site, said method comprising the steps of:

(a) installing at least three support leg substructure units at said installation site, each of said substructure units including a base element resting on the ocean bottom and a central column extending upward from said base to a position a spaced distance above the ocean surface, said support leg substructure units being spaced a sufficient distance from one another that a barge can be floated to a preselected position bounded on at least two opposite sides by said supporting substructure units;

(b) constructing a plurality of slope-sided members each defining a central aperture adapted for receiving a corresponding one of said central columns;

(c) transporting said sloped-sided members to said installation site;

(d) placing each of said sloped-sided members upon a corresponding one of said base elements;

(e) transporting a deck to said installation site on said barge;

(f) positioning said barge between said support leg substructure units; and (g) placing said deck atop said central columns.

17. The method as set forth in claim 16, wherein the step of installing said support leg substructure units includes securing each substructure unit to the ocean bottom with piles prior to positioning the corresponding sloped-sided member on said substructure unit.

18. A method of constructing and installing an arctic offshore structure at an offshore installation site, comprising the steps of:

fabricating a single substructure unit at a fabrication yard, said substructure unit including a base mounted around and attached to a lower portion of a central column, said central column extending upwardly from said base;

fabricating a separate sloped-sided member adapted to be placed upon said substructure unit with said central column extending through a central aperture of said sloped-sided member;

transporting said substructure unit to said offshore installation site and submerging said substructure unit at said offshore installation site so that said base rests on the seafloor and said central column extends above the water line;

securing said substructure unit to the seafloor with piles extending into the seafloor through said base;

transporting said sloped-sided member to the offshore installation site and positioning it on said substructure unit after said substructure unit has been secured to the ocean bottom with piles; and placing a deck structure atop said central column.

19. The method as set forth in claim 18, further including the step of excavating a hole in the seafloor at said offshore installation site prior to submerging said substructure unit, whereby the base of said substructure unit is positioned a spaced distance below the seafloor.

20. The method as set forth in claim 18, further including the step of injecting grout in the annulus defined by said central column and said central aperture after said sloped-sided member is positioned on said substructure unit.

* * * * *